United States Patent [19]

McCain

[11] 4,098,312

[45] Jul. 4, 1978

[54] PURSE FOR ORGANIZING PERSONAL ARTICLES

[76] Inventor: Elizabeth G. McCain, 6006 Pollard Dr., Richmond, Va. 23226

[21] Appl. No.: 837,704

[22] Filed: Sep. 27, 1977

Related U.S. Application Data

[63] Continuation-in-part of Ser. No. 698,602, Jun. 22, 1976, abandoned.

[51] Int. Cl.[2] ..... A45C 3/06

[52] U.S. Cl. ..... 150/35; 150/34; 312/227

[58] Field of Search ..... 150/28 R, 30, 33, 34, 150/35; 312/226, 227

[56] References Cited

U.S. PATENT DOCUMENTS

| | | | |
|---|---|---|---|
| 2,937,680 | 5/1960 | Dumas | 150/35 |
| 3,186,462 | 6/1965 | Nash | 150/34 |
| 3,194,291 | 7/1965 | Oakes | 150/28 R |
| 3,251,637 | 5/1966 | Parsons | 312/227 |

*Primary Examiner*—Donald F. Norton

*Attorney, Agent, or Firm*—Mason, Fenwick & Lawrence

[57] ABSTRACT

A purse having a handle for carrying purposes and a series of clearly identified drawers which are firmly locked when in a closed position, with separate drawers provided for different types of personal articles, such as billfolds, bankbooks, glasses, and the like with a hinged mirror, covering a make-up drawer and foldable back against the purse to a viewing position when the drawer is pulled out for use.

5 Claims, 8 Drawing Figures

PURSE FOR ORGANIZING PERSONAL ARTICLES

This is a continuation in part of application Ser. No. 698,602 filed June 22, 1976 and now abandoned.

BACKGROUND OF THE INVENTION

This invention relates to a purse for carrying personal articles and more particularly to an improved purse which permits easy retrieval of the personal articles.

In prior known purses, considerable groping and fumbling have often been necessary to retrieve a desired article. Most purses available on the market today have one or more relatively large compartment into which one must place numerous personal articles which necessitates emptying the contents of the purse at times to find a desired article. An obvious need exists in the marketplace for a purse or handbag which permits easy retrieval of personal articles in organized fashion.

Accordingly, it is the principal object of this invention to provide a novel and improved purse for carrying and organizing personal articles.

Another object of the present invention is to provide a purse with drawers which can be readily identified to show the contents of each drawer.

an additional object of the present invention is to provide a purse which is convenient and easy to use.

A still further object of the present invention is to provide a purse which is simple and economical to manufacture.

Other objects and advantages of the invention will become apparent to those persons having ordinary skill in the art to which the invention pertains, from the following description taken in conjunction with the accompanying drawings wherein.

Figure 2:
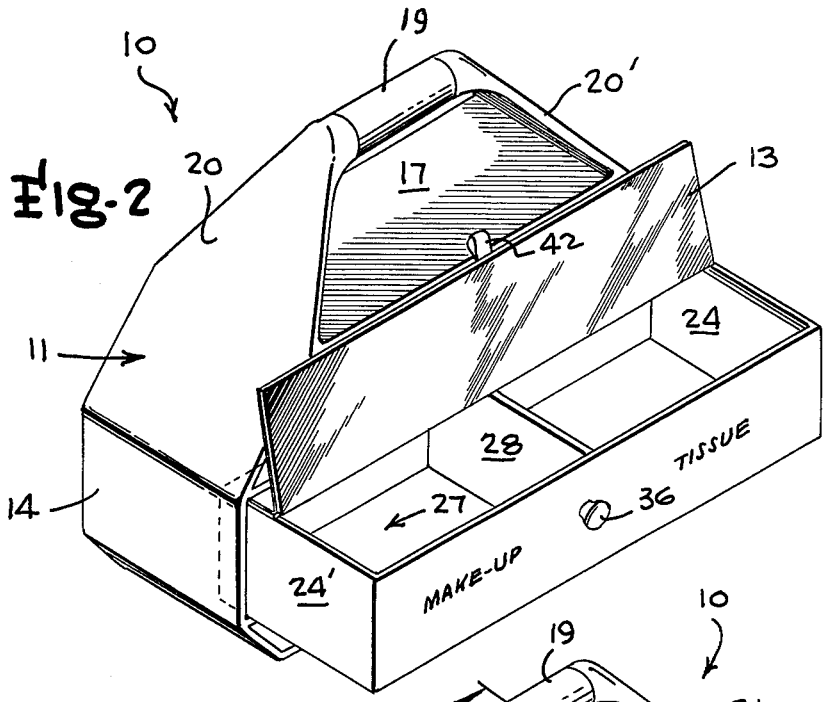
FIG. 2 is a perspective view of the purse shown in FIG. 1 with a makeup drawer open and a top mirror lifted up and positioned against the purse for use.

Referring to the figures, there is illustrated a purse embodying the present invention and designated generally by the reference numeral 10. The purse includes a carrying case 11, a series of drawers 12, and hinged mirror 13 on a makeup drawer.

The carrying case 11 is constructed of durable material, such as leather or plastic, and is fabricated either from a single piece of material or from numerous pieces of material attached together, such as by stitching or adhesive bonding. The case 11 includes opposed end walls 14 and 15, a bottom wall 16 which may be straight in configuration or, as shown in the drawings, U-shaped and angularly disposed on each end to end walls 14 and 15 and a top wall 17 disposed parallel to the bottom wall 16 and perpendicular to the end walls 14 and 15. A rear wall 18 connects the rear edges of the end walls 14 and 15, the bottom wall 16 and the top wall 17. A handle 19, which is cylindrical in configuration and of sufficient length for the hand of the purse user, is disposed parallel to and a short distance above the top wall 17. The handle is securely connected on each end to the case 11 by straps 20 and 20' to the top edges of the end walls 14 and 15.

Figure 3:
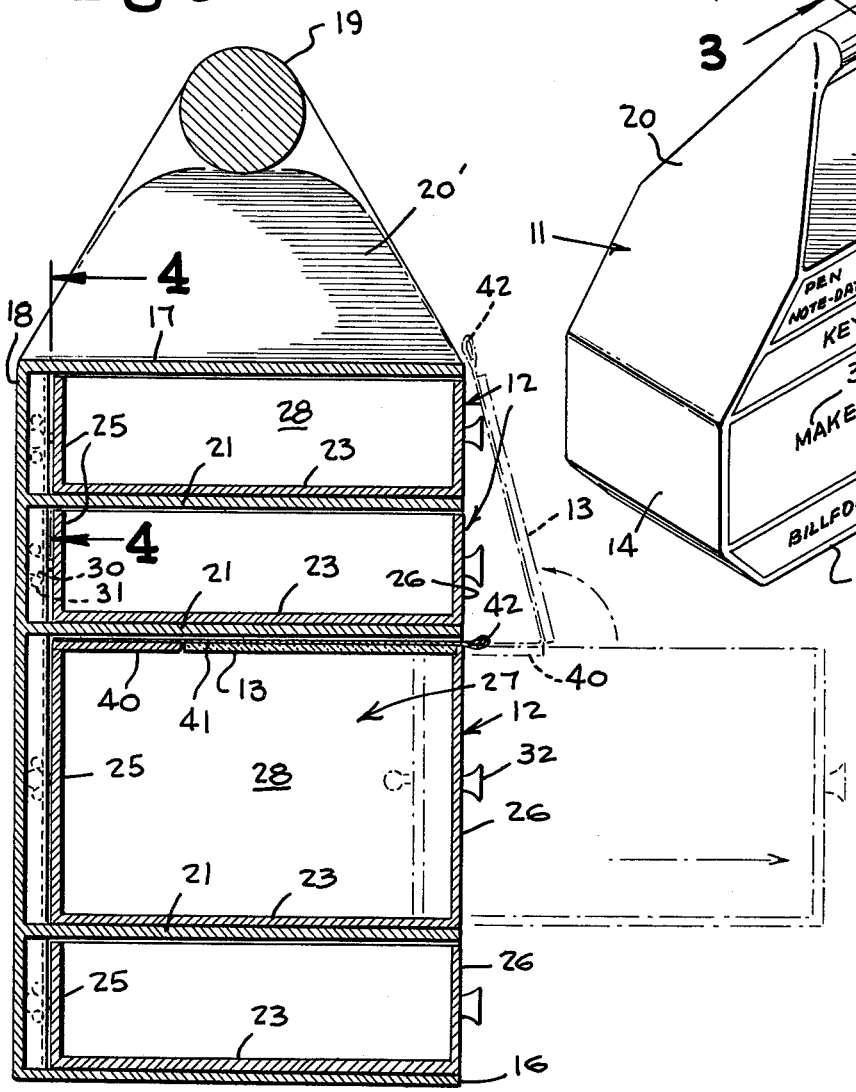
FIG. 3 is a sectional view of the purse taken along line 3—3 in FIG. 1.

The carrying case 11 is further provided with a series of partitions 21, as shown in FIG. 3, constructed of thin stiff material, such as plastic, rigidly affixed to the inside surfaces of the rear wall 18 and end walls 14 and 15. The partitions 21 are perpendicular to said walls, parallel to each other, and spaced apart.

The drawers 12 are constructed of rigid and durable material, such as plastic or wood, and include a bottom wall 23, two side walls 24 and 24' extending perpendicularly from opposite edges of the bottom wall 23, and a rear wall 25 joined to the rear edge of the bottom wall 23 and the rear edges of the side walls 24 and 24'. A front wall 25 extends perpendicularly from the front edges of the side walls 24 and 24' and the bottom wall 23 thereby forming an interior compartment 27.

Figure 7:
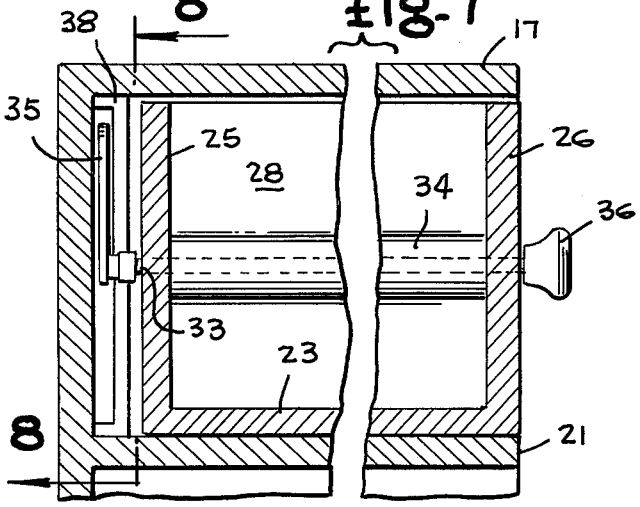
FIG. 7 is a view similar to FIG. 5 but showing the alternate latching device in a latched position.

A divider 28, as shown in FIGS. 2 and 7, may be provided within each of the interior compartments 27 to extend between the rear wall 25 and the front wall 26 to form separate compartments within each drawer 12.

Figure 4:
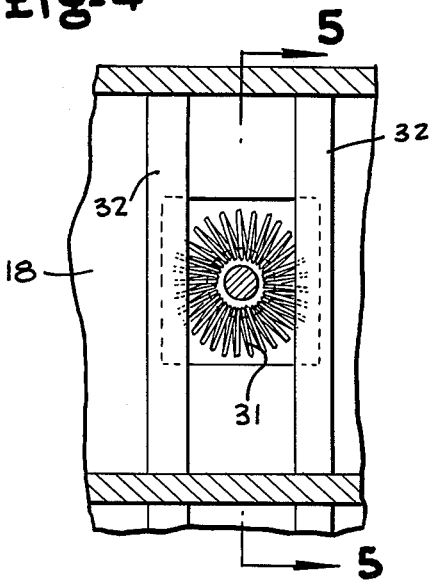
FIG. 4 is a fragmentary sectional view of the purse taken along line 4—4 in FIG. 3.
Figure 5:
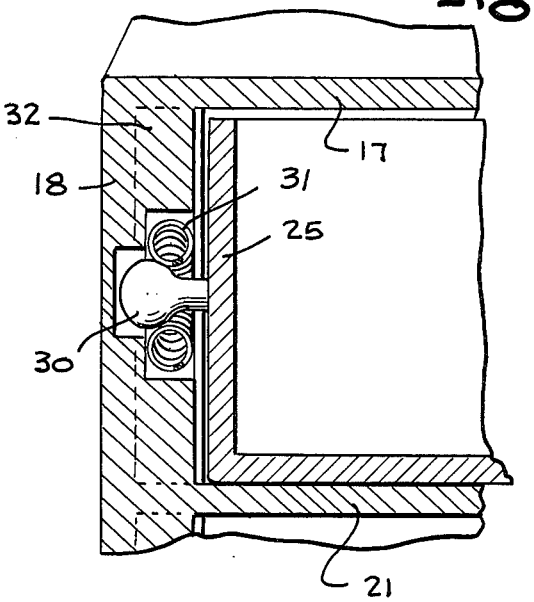
FIG. 5 is a sectional view of the purse taken along line 5—5 in FIG. 4.

The drawers 12 are retained in the closed position by a ball and spring assembly shown in FIGS. 4 and 5. The ball and spring assembly includes a ball shaped member 30 attached to the center of the rear wall 25 of each drawer. The ball member 30 may be formed integrally with the drawer or may be attached to the drawer by a threaded portion, not shown, or the like. The ball member 30 is insertable into the center of a toroidal shaped spring 31 attached to the rear wall 18 by retainer brackets 32. As the drawer approaches the closed position, the ball member 30 contacts the center of the toroidal shaped spring 31 and is then pushed through the spring to the position shown in FIG. 5 where the spring presses against the back of the ball member to retain the drawer in the closed position.

Figure 6:
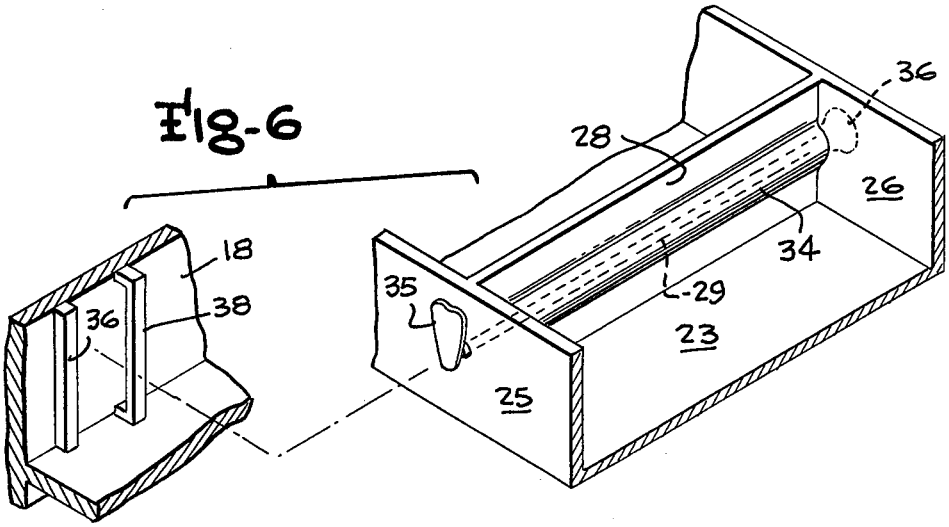
FIG. 6 is an exploded fragmentary side view of the purse showing an alternate latching device.
Figure 8:
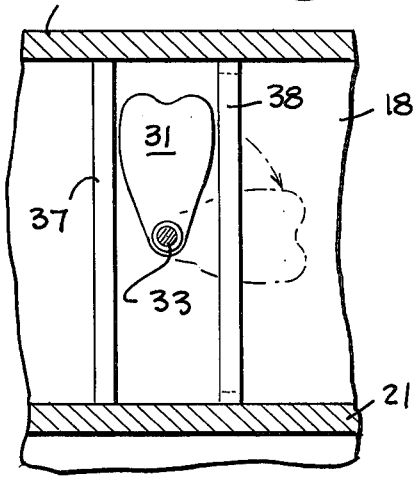
FIG. 8 is a sectional view of the alternate latching device taken along line 8—8 in FIG. 7.

In the alternate embodiment shown in FIGS. 6–8, the stiff wire 33 passes through a tubular portion 34 formed in the divider 28. The stiff wire has a perpendicular flanged inner end 35 and a knob 36 at the outer end which is positioned in the middle of the front wall 26 as indicated in FIGS. 6 and 7.

Figure 1:
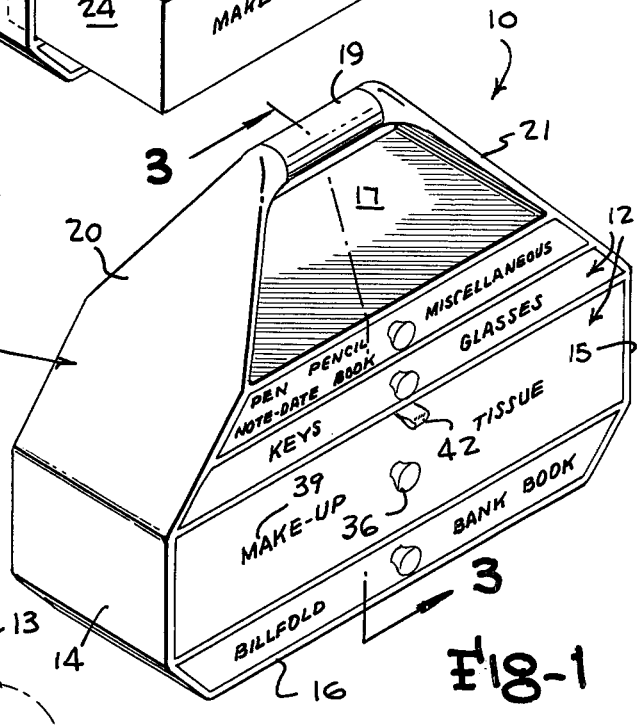
FIG. 1 is a perspective view of a purse embodying the invention.

When the knob 36 is rotated counterclockwise, the flange 35 will rotate to engage a vertical abutment 37 formed on or attached to the rear wall 18. In this position the drawer can be easily opened. When the knob 36 is rotated clockwise, the flange 35 will move behind a retaining abutment 38, as indicated in FIG. 8, to lock the drawer in position and prevent spillage. The contents to be carried in each drawer 12 may be identified with letters shown by the reference numeral 39 as shown in FIG. 1. Each drawer may be identified for different personal articles, such as billfold, bankbook, keys, and the like.

The make-up drawer mirror 13 is formed of conventional glass or highly polished metal and is rectangular in configuration with dimensions slightly less than the width of the interior compartment 27. The mirror section, as shown in FIG. 3, is secured to a cover panel 40 by a hinge 41 formed of canvas, or the like. When the make-up drawer is pulled out, there is a tab 42 on the back of the mirror 13 which can be lifted up and the mirror then rested against the top part of the purse, as shown in FIGS. 2 and 3. In like manner, the mirror may be returned for storage within the carrying case.

An individual would carry the purse 10 by grasping the handle 19 in the conventional manner, or a shoulder strap may also be provided. Personal articles would be kept in the proper drawer as indicated by the letters 39.

When an individual desires to obtain a given personal article, the purse 10 is placed on a flat surface by resting the bottom wall 16 thereupon. The individual selects the appropriate drawer by reading the words formed by the letters 39. The knob 36 would be grasped to pull the drawer open thereby providing easy access to the contents. In the alternate embodiment, the knob would be rotated to pivot the flange 35 from behind the retainer 38. To use the mirror, an individual simply pulls out the make-up and tissue drawer and lifts the mirror upwardly and positions it against the purse. The mirror can then be repositioned in the carrying case by folding it down and closing the drawer.

From the foregoing detailed description, it will be evident that there are a number of changes, adaptations and modifications of the present invention which come within the province of those skilled in the art. However, it is intended that all such variations not departing from the spirit of the invention be considered as within the scope thereof and as limited solely by the appended claims.

We claim:

1. An improved purse for keeping personal articles, said purse comprising a carrying case including opposed end walls connecting a top wall and a bottom wall and a rear wall connecting rear edges of the end walls, a handle disclosed above the top wall and secured to the case, said case additionally including a plurality of partitions spaced apart, parallel to the bottom wall and connected to the carrying cases; a plurality of drawers which fit between the partitions and the case with each drawer being of box-like construction and including a bottom wall, two side walls, a rear wall, and a front wall, a mirror having a hinge attached to one of said drawers with the axis of said hinge spaced apart from said front wall of said drawer and parallel to said bottom wall of said drawer, said mirror pivotable downward to a position adjacent the upper edges of said drawer to permit the drawer to be closed when the mirror is in said position, and means for retaining the drawers in a closed position thereby providing an efficient and convenient purse with a mirror which can be pivoted upwardly to a use position and pivoted downwardly to a storage position which permits closing of the drawer.

2. The purse of claim 1 additionally including symbols on a front surface of each drawer for identifying the types of articles to be stored in each drawer.

3. The purse of claim 1 additionally including a divider in each drawer to separate the drawer into two compartments thereby permitting two or more various articles of the same nature to be kept separately in each drawer.

4. The purse of claim 1 wherein the means for retaining the drawers in a closed position include a ball and spring assembly between a rear wall of one of said drawers and said rear wall of said carrying case, said assembly including a ball number fixed to one of said rear walls and a receiving spring member fixed to the other of said walls, alignable with said ball member and engagable with said ball member when said drawer is in the closed position for retaining said drawer in the closed position.

5. The purse of claim 1 wherein the means for retaining the drawers in a closed position include a shaft extending through the front and rear walls of a drawer, a perpendicular flange attached to the shaft adjacent the outer surface of the rear wall of the drawer, a knob attached to the shaft adjacent the outer surface of the front wall, and a retaining member on the rear wall having a recess positioned to be engagable with said flange when said knob is rotated.

* * * * *